US006113012A

United States Patent [19]

Wear et al.

[11] Patent Number: 6,113,012

[45] Date of Patent: Sep. 5, 2000

[54] RATE SHAPED FUEL INJECTOR WITH INTERNAL DUAL FLOW RATE OFFICE

[75] Inventors: Jerry A. Wear, East Peoria; Lianghe Zuo, Chicago, both of Ill.

[73] Assignee: Caterpillar Inc., Peoria, Ill.

[21] Appl. No.: 09/104,587

[22] Filed: Jun. 25, 1998

[51] Int. Cl.[7] ..... F02M 61/20

[52] U.S. Cl. ..... 239/533.9; 251/52

[58] Field of Search ..... 239/533.3–533.9, 239/88; 251/54, 52, 50

[56] References Cited

U.S. PATENT DOCUMENTS

| | | | |
|---|---|---|---|
| 3,469,793 | 9/1969 | Guertler | 239/533.8 |
| 3,831,863 | 8/1974 | Fenne | 239/533.8 |
| 3,982,694 | 9/1976 | Bailey . | |
| 4,747,545 | 5/1988 | Trachte et al. | 239/533.9 |
| 4,911,366 | 3/1990 | Priesner | 239/533.9 |
| 5,209,403 | 5/1993 | Tarr et al. . | |
| 5,328,094 | 7/1994 | Goetzke et al. . | |
| 5,429,309 | 7/1995 | Stockner . | |
| 5,484,108 | 1/1996 | Nally . | |
| 5,487,508 | 1/1996 | Zuo . | |
| 5,505,348 | 4/1996 | Camplin . | |
| 5,803,370 | 9/1998 | Heinz | 239/533.9 |

FOREIGN PATENT DOCUMENTS

| | | | |
|---|---|---|---|
| 0135872 | 4/1985 | European Pat. Off. . | |
| 2900783 | 7/1979 | Germany | 239/533.8 |
| 1110102 | 4/1968 | United Kingdom . | |
| 2086473 | 5/1982 | United Kingdom . | |

*Primary Examiner*—Kevin Weldon
*Attorney, Agent, or Firm*—Michael B. McNeil

[57] ABSTRACT

A fuel injector nozzle assembly includes a nozzle body that defines a nozzle outlet. A needle valve member is positioned in the nozzle body and moveable between a first position in which the nozzle outlet is blocked and a second position in which the nozzle outlet is open. At least one of the nozzle body and the needle valve member define a first chamber fluidly connected to a second chamber by at least one dual flow rate orifice. The needle valve member displaces fluid from the first chamber into the second chamber through the at least one dual flow rate orifice when moving from its first position to its second position. The dual flow rate orifice is sized and shaped to produce a flow restriction and to slow the movement of the needle valve member when moving from its closed position to its open position, but permit relatively unrestricted displacement flow in the opposite direction.

20 Claims, 3 Drawing Sheets

RATE SHAPED FUEL INJECTOR WITH INTERNAL DUAL FLOW RATE OFFICE

TECHNICAL FIELD

The present invention relates generally to fuel injector nozzle assemblies, and more particularly to the incorporation of a dual flow rate orifice into a fuel injector to rate shape an injection event by slowing the opening rate of the needle check valve.

BACKGROUND ART

Over the years, engineers have come to recognize that undesirable emissions can be reduced, and performance improved, across most of an engine's operating range by making each fuel injection event begin relatively slowly and end as abruptly as possible. This type of injection mass flow rate profile is more commonly referred to in the art as rate shaping. It is well known that there have been a wide variety of devices and schemes proposed for producing desired fuel injection rate shapes for as many different fuel injectors. Unfortunately, many of these proposals are too complex for realistic mass production or too difficult to manufacture in a way that produces consistent reliable results. Others improve a front end rate shape by sacrificing on an abrupt end to injection, or vice versa.

The present invention is directed to these and other problems associated with the production of desired rate shapes in fuel injectors.

DISCLOSURE OF THE INVENTION

A fuel injector nozzle assembly includes a nozzle body that defines a nozzle outlet. A needle valve member is positioned in the nozzle body, and is moveable between a first position in which the nozzle outlet is blocked and a second position in which the nozzle outlet is open. At least one of the nozzle body and the needle valve member define a first chamber fluidly connected to a second chamber by at least one dual flow rate orifice. The needle valve member displaces fluid from the first chamber into the second chamber through the at least one dual flow rate orifice when moving from its first position to its second position.

BEST MODE FOR CARRYING OUT THE INVENTION

Figure 1:
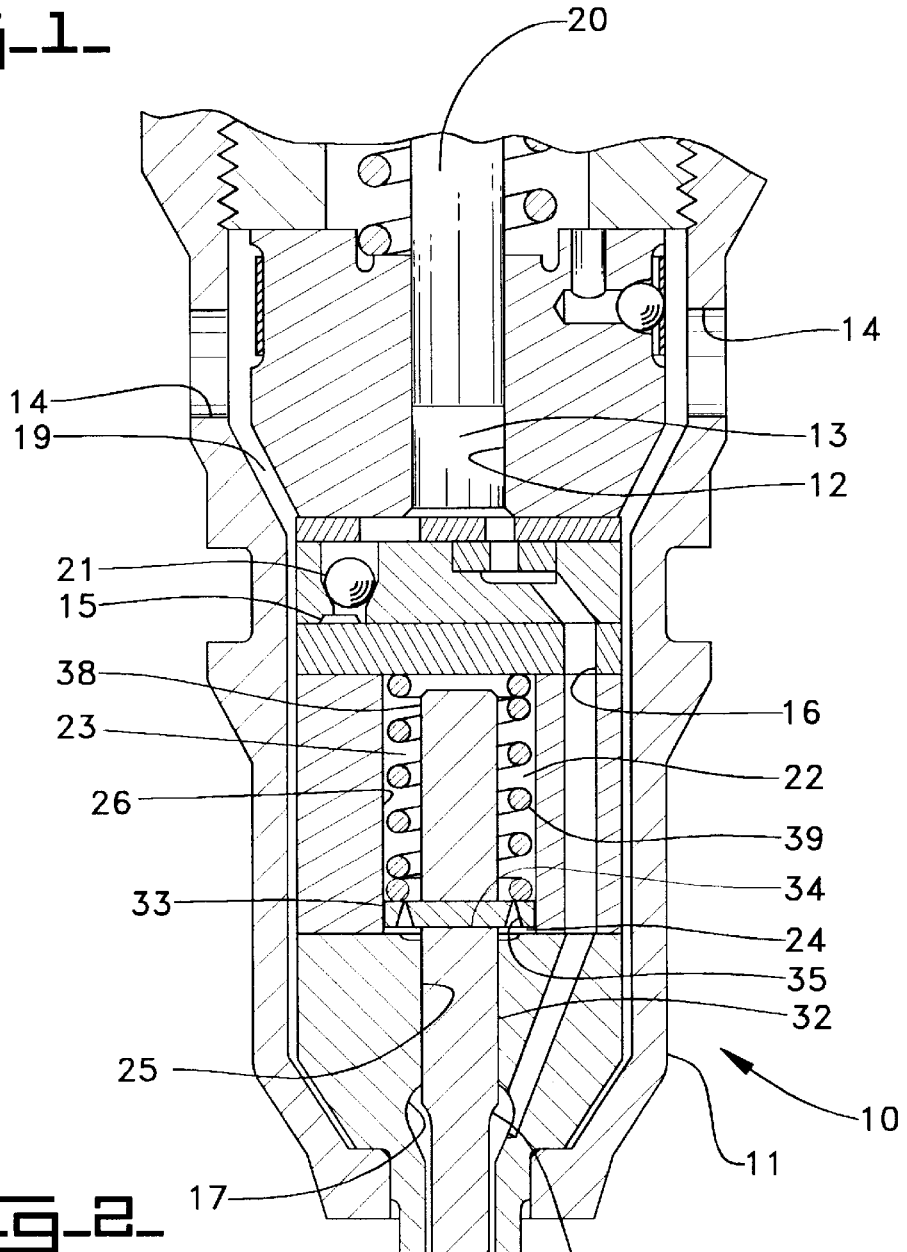
FIG. 1 is a partial front sectioned diagrammatic view of a fuel injector according to one embodiment of the present invention.

Referring now to FIG. 1, a fuel injector 10 includes an injector body 11 made up of a plurality of machined components attached to one another in a manner well known in the art. Injector body 11 defines a plunger bore 12 within which a plunger 20 is driven to reciprocate via some suitable means, such as hydraulic fluid pressure or a cam driven tappet assembly. A portion of plunger 20 and plunger bore 12 define a fuel pressurization chamber 13 that is in fluid communication with a nozzle outlet 18 via a nozzle supply passage 16 and a nozzle chamber 17. When plunger 20 is undergoing its upward return stroke between injection events, fresh fuel is drawn into fuel pressurization chamber 13 through fuel inlet 14, along annular nozzle supply passage 19, through fuel supply passage 15, past check valve 21 and into plunger bore 12. When plunger 20 is undergoing its downward pumping stroke, check valve 21 is closed and fuel is forced into a combustion space within an engine through nozzle outlet 18 in a conventional manner.

As in a typical fuel injector, a needle valve member 30 is positioned in a nozzle body portion of injector body 11, and is moveable between an open position in which nozzle outlet 14 is open, and a closed position, as shown, in which nozzle outlet 14 is blocked. Needle valve member 30 includes a needle portion 36, a guide portion 32, a disc shaped spacer portion 33 and a pin stop portion 38. While these portions of the needle valve member could be machined from a single solid piece of a suitable metallic alloy, they are preferably machined as several separate components that are stacked atop one another as shown in FIG. 1. Needle valve member 30 includes a lifting hydraulic surface 31 exposed to fluid pressure in nozzle chamber 17, and a closing hydraulic surface 34 exposed to fluid pressure in a trapped volume chamber 22, which is defined by injector body 11.

Fuel injector 10 employs trapped volume nozzle technology in order to hasten the closure rate of the needle valve member, as described in co-owned U.S. Pat. No. 5,429,309 to Stockner. The relatively tight clearance between guide portion 32 and guide bore 25 causes trapped volume 22 to be relatively isolated and closed. Trapped volume chamber 22 is divided into a lower chamber 24 and an upper chamber 23 by spacer portion 33. Trapped volume chamber 22 is defined by a spacer guide bore 26, which has a relatively tight annular clearance 37 with spacer portion 33 so that the only substantive fluid connection between upper chamber 23 and lower chamber 24 is through dual flow rate orifices 35.

Figure 2:
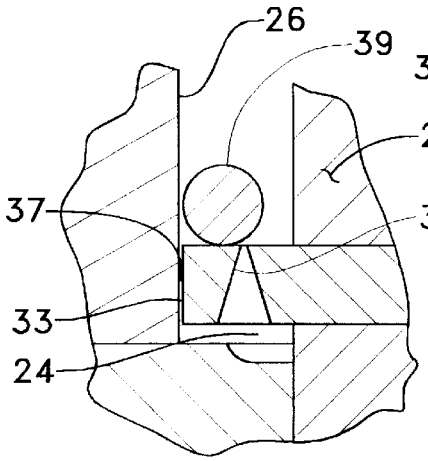
FIG. 2 is an enlarged sectioned diagrammatic view of a dual flow rate orifice portion of the fuel injector of FIG. 1 according to one aspect of the present invention.

Referring now in addition to FIG. 2, needle valve member 30 is normally biased downward to its closed position by needle biasing spring 39, which is positioned in trapped volume chamber 22. When fuel pressure in nozzle chamber 17 acting on lifting hydraulic surfaces 31 is above a threshold valve opening pressure, needle valve member 30 will lift to its open position against the action of needle biasing spring 39, to commence an injection event.

When needle valve member 30 lifts, the volume of trapped chamber 22 decreases, which results in an increase in pressure. At the same time, in order for needle valve member to move upward, some fluid from upper chamber 23 must be displaced into lower chamber 24 through dual flow rate orifices 35. The present invention seeks to hydraulically slow the opening rate of needle valve member 30 by constricting this flow through dual rate flow orifices 35. In other words, if dual flow rate orifices 35 are appropriately sized, a flow restriction can take place when fluid must be displaced from upper chamber 23 into lower chamber 24 when needle valve member 30 is moving upward to its open position. This creates a temporary pressure gradient between upper chamber 23 and lower chamber 24 that hydraulically slows the opening rate of needle valve member 30. This slowing of the needle valve open rate produces a corresponding slower increase in the fuel injection rate out of nozzle outlet 18. Thus, in order to produce the front end rate shaping according to the present invention, dual flow rate orifices 35 must present a flow restriction for fluid flow moving from upper chamber 23 to lower chamber 24.

In order to not undermine the closure rate of needle valve member 30 at the end of an injection event, it is important that dual flow rate orifices have different flow rate characteristics for fluid flow moving from lower chamber 24 to upper chamber 23. This is accomplished by shaping orifices 35 to have a relatively low flow rate coefficient for fluid flow from bottom chamber 24 to upper chamber 23, but a relatively high flow rate coefficient for fluid flow in the reverse direction. A substantial difference in flow rate coefficients is desired, which corresponds to a difference in excess of 30%. These flow characteristics can be created with a wide variety of non-symmetrical shapes, such as the frusto conical shape shown in FIGS. 1 and 2. By appropriately sizing and tuning dual flow rate orifices 35, some front end rate shaping can be produced without undermining the ability of the injector to produce a relatively abrupt end to the injection event.

Each injection event begins shortly after plunger 20 starts its downward pumping stroke. This causes fuel pressure in fuel pressurization chamber 13 and nozzle chamber 17 to rise rapidly. Before needle valve member 30 lifts to its open position, fluid pressure in trapped volume chamber 22 is relatively low, or on the order of the fluid pressure in fuel inlet 14. When the pressure in nozzle chamber 17 exceeds the valve opening pressure, needle valve member 30 begins to lift to commence the injection event. When this occurs, fluid is displaced from upper chamber 23 into lower chamber 24 through dual flow rate orifice 35. Because of the flow restriction, needle valve member 30 is hydraulically slowed in its movement, and the injection flow rate at this front end portion of the injection event rises much slower than a prior art injection event in which the needle valve member is not restricted in its movement.

While the needle valve member continues moving upward to its open position, pressure rises in trapped volume chamber 22. This is due to the decrease in total volume when the end of guide portion 32 is moved into the trapped volume space. Also, because the fuel pressure in nozzle chamber 17 is relatively high, some of that fluid pressure migrates up the tight clearance area in guide bore 25 further raising the fluid pressure in trapped volume chamber 22 during the injection event. The temporary difference in pressure between upper chamber 23 and lower chamber 24 during the initial opening of needle valve member 30 quickly dissipates after pin stop portion 38 has reached its upper stop. Thus, during the injection event the pressure in the upper and lower chambers equalizes to a relatively high pressure in accordance with trapped volume nozzle technology. The injection event ends when the plunger 20's downward stroke slows sufficiently that a fuel pressure drop occurs in nozzle chamber 17. When this pressure drops through a certain threshold value, the combined hydraulic force due to pressure in trapped chamber 22 acting on closing hydraulic surface 34 plus the spring force from biasing spring 39 causes needle valve member 30 to begin moving downward to its closed position. When this occurs, fluid in bottom chamber 24 must be displaced into upper chamber 23 through dual flow rate orifices 35. However, because of the high flow rate coefficient due to shape of these orifices, no significant flow restriction occurs and needle valve member 30 closes at nearly the same abrupt rate as a prior art needle valve member of the type described in the earlier identified Stockner patent.

Figure 3:
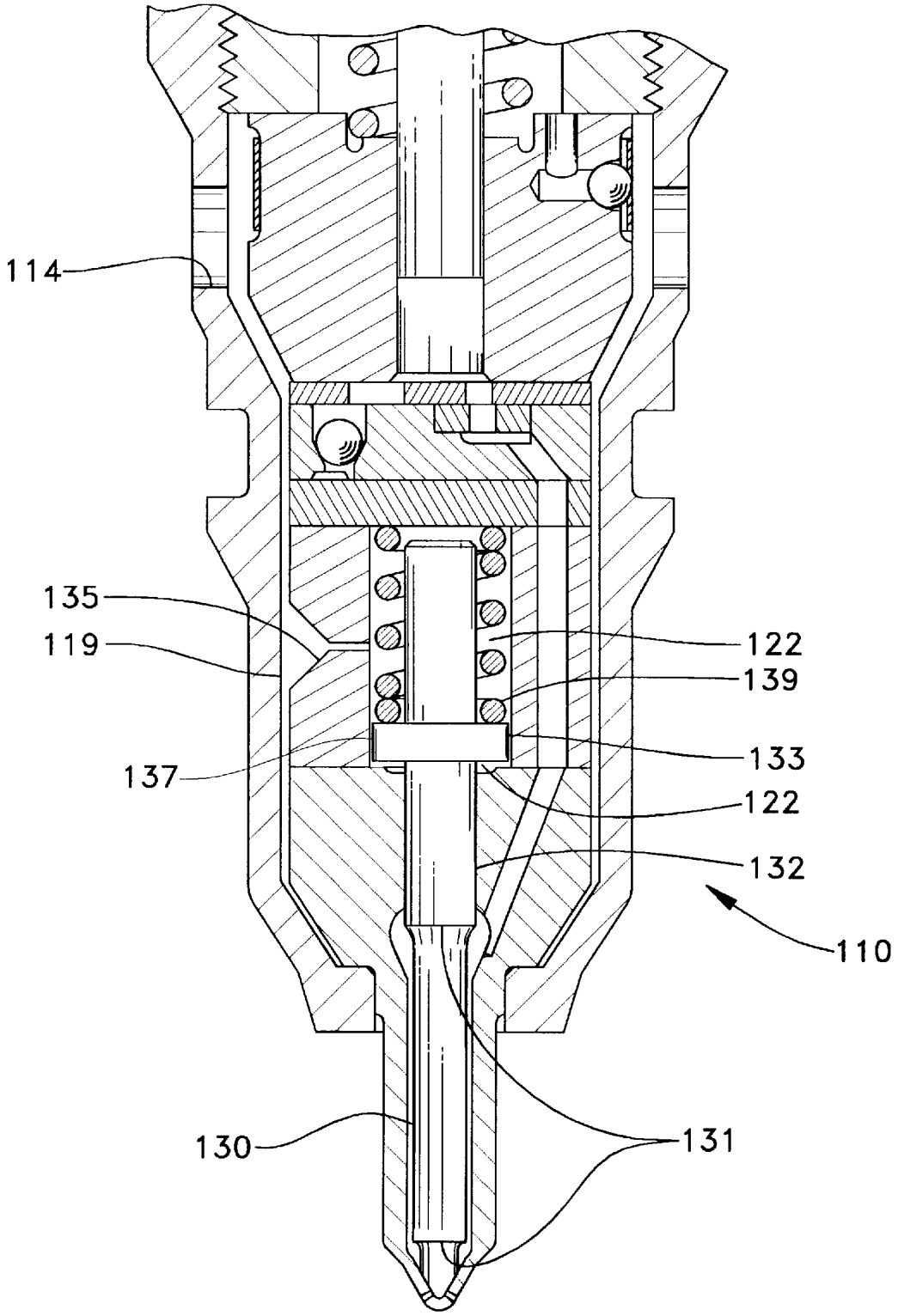
FIG. 3 is a partial front sectioned diagrammatic view of a fuel injector according to another embodiment of the present invention.
Figure 4:
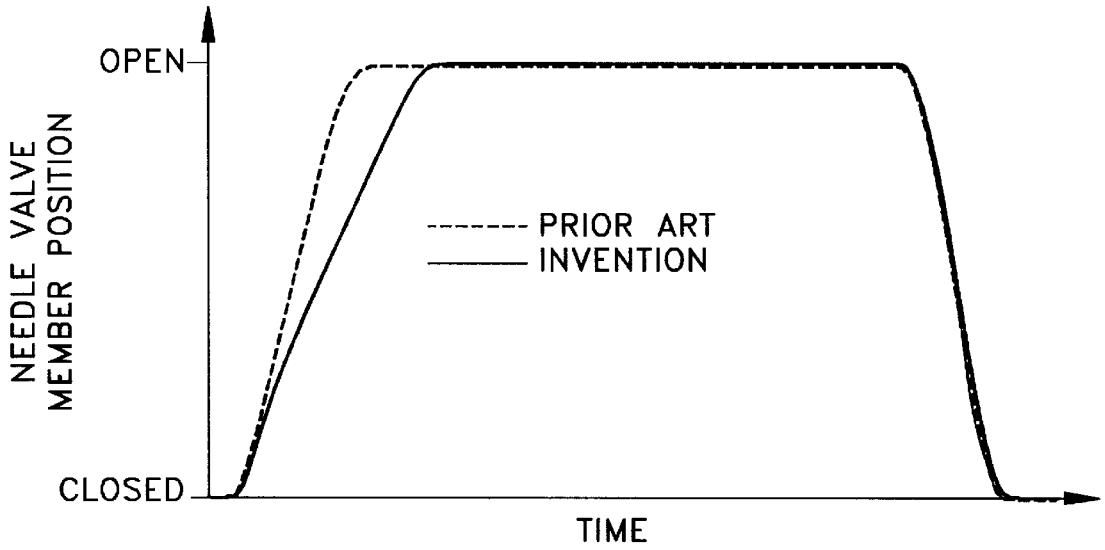
FIG. 4 is a graph of needle valve member position versus time for an injection event according to the prior art and present invention.
Figure 5:
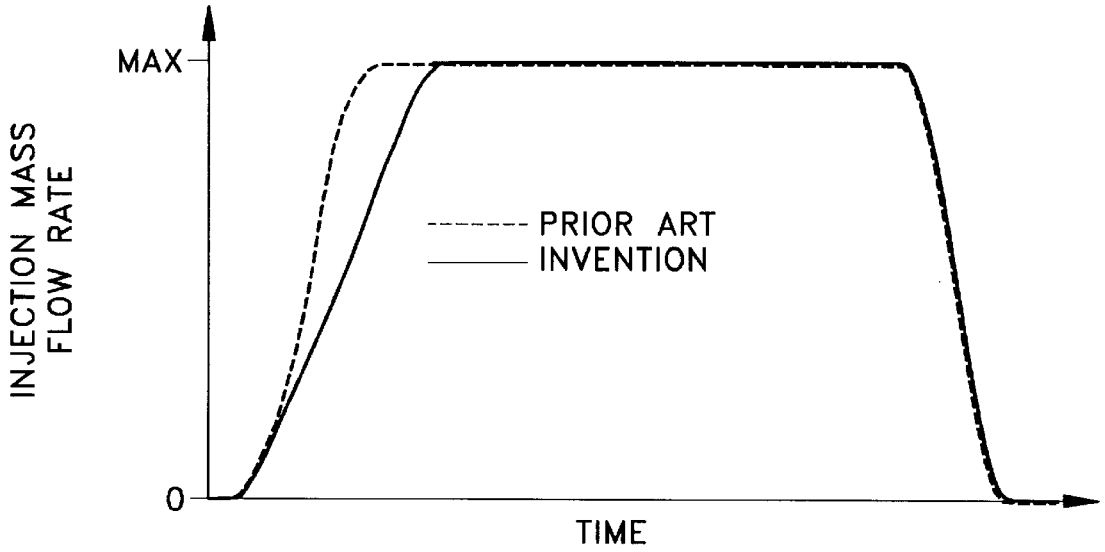
FIG. 5 is a graph of injection mass flow rate versus time for an injection event according to the prior art and present invention.

Referring now to FIG. 3, a fuel injector 110 according to another embodiment of the present invention uses a dual flow rate orifice 135 to produce front end rate shaping in a nozzle assembly that does not include a trapped volume chamber above a needle valve member 130. In this example, spring chamber 122, which holds needle biasing spring 139, is always connected to the relatively low pressure of fuel inlet 114 via an annular fuel return/supply chamber 119 and dual flow rate orifice 135. This embodiment also differs from the previous embodiment in that a relatively large annular clearance area 137 exists between the wall of spring chamber 122 and the outer surface of spacer portion 133 as in the prior art fuel injectors of this type. In other words, this clearance area is sufficiently large that no real flow restriction exists when fluid is displaced between the area underneath spacer 133 and the area above. When needle valve member 130 lifts to its open position, fluid in spring chamber 122 is displaced through dual flow rate orifice 135 into annular fuel return/supply chamber 119. By appropriately sizing and shaping orifice 135, a flow restriction is created that slows the opening rate of needle valve member 130 in a manner similar to that of the embodiment shown in FIGS. 1 and 2. Thus, the initial injection rate is slowed to produce front end rate shaping, and the injection event ends substantially identical to similar prior art fuel injectors of this type in that the closure rate of the needle valve member is tied only to the strength of biasing spring 139 and the rate of fuel pressure drop in the nozzle chamber.

INDUSTRIAL APPLICABILITY

The present invention finds potential application in any fuel injector where it is desired to have a needle valve member that opens at one slower rate and closes at another faster rate. The present invention accomplishes this by arranging the components in such a way that a first chamber is separated from a second chamber by a dual flow rate orifice. These components are arranged such that when the needle valve member moves to its open position, fluid is displaced from one chamber to the other chamber through the dual flow rate orifice. The shape and sizing of the dual flow rate orifice are preferably arranged such that a flow restriction is created when the needle valve member is moving toward its open position so that its opening rate is slowed and the initial injection rate is shaped. The hydraulic slowing of the present invention can be further tuned through sizing of the two chambers, closing or venting the chambers and by controlling the total volume of fluid that must be displaced between the chambers when the needle valve opens. Because fluid must flow through the dual flow rate orifice in the reverse direction when the needle valve member is closing, the orifice is shaped and sized such that it permits relatively unrestricted flow in this reverse direction when the needle valve member is moving toward its closed position. This ensures that the closure rate of the needle valve member is not undermined. Those skilled in the art will appreciate that a wide variety of different shaped passageways can produce the dual flow rate characteristics of the present invention. The flow coefficient in one direction can be as much as 30% up to 100%, or more, higher than the flow coefficient in the reverse direction. This difference in flow coefficience allows the dual flow rate orifice to functionally produce a restriction in one direction but have a virtually negligible effect in the opposite direction.

The above description is intended for illustrative purposes only, and is not intended to limit the scope of the present invention in any way. For instance, another embodiment of the present invention could include shaping the spacer element to have a frusto conical shape such that flow around its outer surface when the needle valve member moves creates an annular dual flow rate orifice in accordance with the present invention. Thus, various modifications could be made to the disclosed embodiments without departing from the intended spirit and scope of the present invention, which is defined in terms of the claims set forth below.

We claim:

1. A nozzle assembly comprising:

a nozzle body defining a nozzle outlet;

a needle valve member positioned in said nozzle body, and being moveable between a first position in which said nozzle outlet is blocked and a second position in which said nozzle outlet is open;

at least one of said nozzle body and said needle valve member defining a first chamber fluidly connected to a second chamber by at least one dual flow rate orifice;

said needle valve member displacing an amount of fluid from said first chamber when moving from said first position to said second position; and substantially all of said amount of fluid being displaced through said at least one dual flow rate orifice.

2. The nozzle assembly of claim 1 wherein said at least one dual flow rate orifice has a first flow rate coefficient for fluid flow from said first chamber to said second chamber;

said at least one dual flow rate orifice has a second flow rate coefficient for fluid flow from said second chamber to said first chamber; and said first flow rate coefficient is substantially smaller than said second flow rate coefficient.

3. The nozzle assembly of claim 2 wherein said first chamber and said second chamber are parts of a trapped volume chamber.

4. The nozzle assembly of claim 2 wherein said needle valve member includes a disc shaped spacer that separates said first chamber from said second chamber.

5. The nozzle assembly of claim 4 wherein said at least one dual flow rate orifice is defined by said spacer.

6. The nozzle assembly of claim 2 wherein said nozzle body defines said at least one dual flow rate orifice.

7. The nozzle assembly of claim 6 wherein said second chamber is a low pressure fuel supply/return area.

8. The nozzle assembly of claim 6 further comprising a compression spring operably positioned in said first chamber to bias said needle valve member toward said first position.

9. The nozzle assembly of claim 2 wherein said at least one dual flow rate orifice includes a conical portion.

10. The nozzle assembly of claim 2 wherein said at least one dual flow rate orifice is sufficiently restrictive to fluid flow that said needle valve member is hydraulically slowed when moving from said first position to said second position due to a pressure increase in said first chamber.

11. A fuel injector comprising:

an injector body defining a nozzle outlet;

a needle valve member positioned in said injector body, and being moveable between a first position in which said nozzle outlet is blocked and a second position in which said nozzle outlet is open;

at least one one said injector body and needle valve member defining a first chamber fluidly connected to a second chamber by at least one dual flow rate orifice;

said needle valve member displacing an amount of fluid from said first chamber when moving from said first position to said second position;

substantially all of said amount of fluid being displaced through said at least one dual flow rate orifice; and a compression spring operably positioned in one of said first chamber and said second chamber to bias said needle valve member toward said first position.

12. The fuel injector of claim 11 wherein said at least one dual flow rate orifice is sufficiently restrictive to fluid flow that said needle valve member is hydraulically slowed when moving from said first position to said second position due to a pressure increase in said first chamber.

13. The fuel injector of claim 12 wherein said at least one dual flow rate orifice has a first flow rate coefficient for fluid flow from said first chamber to said second chamber;

said at least one dual flow rate orifice has a second flow rate coefficient for fluid flow from said second chamber to said first chamber; and said first flow rate coefficient is substantially smaller than said second flow rate coefficient.

14. The fuel injector of claim 13 wherein said first chamber and said second chamber are parts of a trapped volume chamber.

15. The fuel injector of claim 14 wherein said needle valve member includes a disc shaped spacer that separates said first chamber from said second chamber.

16. The fuel injector of claim 15 wherein said at least one dual flow rate orifice is defined by said spacer.

17. The fuel injector of claim 13 wherein said injector body defines said at least one dual flow rate orifice.

18. The fuel injector of claim 17 wherein said injector body defines a fuel inlet; and said second chamber is fluidly connected to said fuel inlet.

19. The fuel injector of claim 13 wherein said at least one dual flow rate orifice includes a conical portion.

20. A fuel injector comprising:

an injector body defining a nozzle outlet and a trapped volume chamber;

a needle valve member positioned in said injector body, and being moveable between a first position in which said nozzle outlet is blocked and a second position in which said nozzle outlet is open, and said needle valve member includes a spacer positioned in said trapped volume chamber;

said spacer dividing said trapped volume chamber into a first chamber and a second chamber, and said spacer defining at least one dual flow rate orifice fluidly connecting said first chamber to said second chamber, and said at least one dual flow rate orifice including a conical portion;

said needle valve member displacing fluid from said first chamber into said second chamber through said at least one dual flow rate orifice when moving from said first position to said second position;

a compression spring operably positioned in said injector body to bias said needle valve member toward said first position;

said at least one dual flow rate orifice being sufficiently restrictive to fluid flow that said needle valve member is hydraulically slowed when moving from said first position to said second position due to a pressure increase in said first chamber;

said at least one dual flow rate orifice has a first flow rate coefficient for fluid flow from said first chamber to said second chamber and a second flow rate coefficient for fluid flow from said second chamber to said first chamber; and said first flow rate coefficient is substantially smaller than said second flow rate coefficient.

* * * * *